US010930453B2

(12) United States Patent
Hoogvliet et al.

(10) Patent No.: US 10,930,453 B2
(45) Date of Patent: Feb. 23, 2021

(54) ROTARY SWITCH

(71) Applicant: EWAC HOLDING B.V., Rotterdam (NL)

(72) Inventors: Roy Hoogvliet, Rotterdam (NL); Martijn Desiré Beun, Rotterdam (NL)

(73) Assignee: EWAC HOLDING B.V.

( * ) Notice: Subject to any disclaimer, the term of this patent is extended or adjusted under 35 U.S.C. 154(b) by 0 days.

(21) Appl. No.: 16/486,033

(22) PCT Filed: Feb. 14, 2018

(86) PCT No.: PCT/EP2018/053684
§ 371 (c)(1),
(2) Date: Aug. 14, 2019

(87) PCT Pub. No.: WO2018/149878
PCT Pub. Date: Aug. 23, 2018

(65) Prior Publication Data

US 2020/0051763 A1 Feb. 13, 2020

(30) Foreign Application Priority Data

Feb. 17, 2017 (EP) ..... 17156651

(51) Int. Cl.
*H01H 19/04* (2006.01)
*H01H 19/08* (2006.01)
(Continued)

(52) U.S. Cl.
CPC ..... *H01H 19/04* (2013.01); *H01H 19/08* (2013.01); *H01H 19/14* (2013.01); *H01H 19/64* (2013.01)

(58) Field of Classification Search
CPC ..... H01H 19/04; H01H 19/08; H01H 19/14; H01H 19/64; H01H 1/42; H01H 19/10;
(Continued)

(56) References Cited

U.S. PATENT DOCUMENTS 4,510,360 A * 4/1985 Golub ..... H01H 9/30 200/11 B
4,518,832 A * 5/1985 Geremia ..... H01H 25/06 200/14
(Continued)

FOREIGN PATENT DOCUMENTS

CN 205789650 U 12/2016
EP 2107581 A1 10/2009
(Continued)

OTHER PUBLICATIONS

International Search Report and Written Opinion for International Application No. PCT/EP2018/053684; dated Apr. 20. 2018.
(Continued)

*Primary Examiner* — Anthony R Jimenez
*Assistant Examiner* — Lheiren Mae A Caroc
(74) *Attorney, Agent, or Firm* — Mendelsohn Dunleavy, P.C.

(57) ABSTRACT

Rotary switch (1, 101) comprising: —a rotor (15, 115) supporting at least one electro-conductive rotary contact bridge (19, 119); —a plurality of stationary contacts (21, 121); —a housing (3, 103) accommodating the stationary contacts and the rotor. The housing comprises a plurality of sides (5, 105) extending between a top side and a bottom side. At least two of these sides (5, 105) are provided with access openings (62, 62) providing access to an associated stationary contact. These sides make an angle with each other. The housing may for example be rectangular.

17 Claims, 11 Drawing Sheets

(51) Int. Cl.
*H01H 19/14* (2006.01)
*H01H 19/64* (2006.01)

(58) Field of Classification Search
CPC .... H01H 19/12; H01H 9/0005; H01H 9/0016; H01H 9/0027; H01H 9/0044; H05K 7/142; H05K 7/1425; H05K 9/0062; H05K 9/0016; H05K 7/023; H05K 1/144; H01L 23/552; H01L 25/0657; G06F 1/181; G06F 1/184
USPC ..... 200/243, 244, 570, 571, 564, 336, 11 R, 200/14, 11 TC
See application file for complete search history.

(56) References Cited

U.S. PATENT DOCUMENTS 4,861,949 A 8/1989 Bortolloni et al.
6,693,247 B1 * 2/2004 Byers ..... H01H 9/0027 200/11 TC
8,658,923 B2 * 2/2014 Weber ..... H01H 19/02 200/293
9,412,528 B2 * 8/2016 Wu ..... H01H 1/5855
2015/0287551 A1 * 10/2015 Uitto ..... H01H 1/2041 200/243
2015/0332877 A1 11/2015 Civettini

FOREIGN PATENT DOCUMENTS

FR 1032123 A 6/1953
FR 1474128 A 3/1967
GB 1159729 A 7/1969
SU 1023424 A1 6/1983
WO WO2009121744 A1 10/2009
WO WO2013079091 A1 6/2013

OTHER PUBLICATIONS

Communication pursuant to Article 94(3) EPC for corresponding European application No. 17156651.6; dated Dec. 4, 2020 (5 pages).

* cited by examiner

ROTARY SWITCH

FIELD OF INVENTION

The present invention pertains to a rotary switch, e.g., an electric rotary control switch.

BACKGROUND

Though rotary switches are typically substantially cylindrical, it has been proposed to use rectangular lay-outs, such as for instance in WO 2009/121744, in particular for cam switches, such as the one disclosed in U.S. Pat. No. 4,861,949.

With these prior art switches stationary contacts are accessible from a front side and a rear side. These rectangular prior art switches can be switched between only a limited number of positions. Particularly for a control switch a larger number of selectable rotary positions may be desirable.

It is an object of the present invention to provide a compact rotary switch offering a larger number of switchable rotary positions.

SUMMARY OF THE INVENTION

The object of the invention is achieved with a rotary switch comprising:

- a rotor supporting at least one electro-conductive rotary contact bridge;
- a plurality of stationary contacts;
- a housing accommodating the stationary contacts and the rotor. The rotor is rotatable within the housing between a plurality of positions, in which the rotary contact bridge contacts different pairs of stationary contacts. The housing comprising a plurality of sides extending between a top side and a bottom side. At least two of these sides are provided with access openings providing access to an associated stationary contact, said sides making an angle with each other. This way the number of stationary contacts can be increased, since not only two opposite sides are used to provide access to the stationary contacts, as is the case with prior art switches. A very compact design can be realized with relatively large number of stationary contacts.

In a particular embodiment, the housing can be polygonal, e.g., hexagonal or rectangular, e.g., square in top view. The housing may have a plurality of substantially flat vertical sides provided with openings providing access to respective stationary contacts. In this respect, the expression vertical refers to an orientation substantially parallel to a rotary axis of the rotor of the rotary switch, regardless of an actual orientation of the switch.

In a particular embodiment, the switch may be a multi-deck switch with a stack of decks, at least one of the decks accommodating two stationary contacts at each side. For example, the housing may be a rectangular multi-deck housing, each deck accommodating an array of eight stationary contacts. Per deck, the stationary contacts may be symmetrically arranged, e.g., symmetrical relative to a diagonal and/or to a center line in top view, e.g., symmetrical in top view relative to the rotary axis of the rotor.

To accommodate a contact bridge of the rotor, each deck of the multi-deck housing may be provided with a circular recess with a diameter matching the length of the contact bridge. The circular recess may for example be provided at a top surface of the deck. Cavities for accommodating stationary contacts may be arranged around the circular recess, e.g., two symmetrically arranged cavities at each side of the deck.

The decks may for example be held together by means of bolts. The bolts may for example extend through vertical passages within the housing, e.g., at each side of the deck through a section partitioning the two respective cavities for accommodating stationary contacts. Alternatively, or additionally, the decks may be fastened to each other by other means, e.g., a by snap joints.

In a specific embodiment, the rotor may comprise a plurality of rotary contact bridges, e.g., one contact bridge per deck in a multi-deck housing. Each rotary contact bridge may comprise two contacts at opposite sides relative to a rotational axis of the rotor.

In a specific embodiment, the housing may comprise a recess along a corner edge between two adjacent vertical sides, the openings providing access to the stationary contacts being provided in said recess. This way, an access opening can be provided for a given stationary contact at a given housing side in a wall of the recess which can be substantially perpendicular to the side face of that housing side. This way the openings can be configured to provide access in a direction substantially parallel to the respective side face. As a result, the stationary contacts can effectively be shielded against unintentional contact by a user's fingers.

The stationary contacts may comprise a connection portion for connecting to a terminal end of a conductor, the connection portion being substantially parallel to the respective side face. Optionally, the connection portion of the stationary contact may, amongst others, comprise a washer and a screw, or a screw with a clamping plate, for fastening the conductor, the side face being provided with an opening providing access to the screw, which contributes to further protection of a user's fingers.

In a specific embodiment, the rotor may comprise a shaft with a substantially square cross section, e.g., having a steel core encased in a square isolative sheath. Optionally, the shaft may be a modular spindle, such as the modular spindle disclosed in WO 2009/121744, e.g., comprising spindle modules which are mechanically connected or connectable to form a shaft or spindle carrying the rotary contact bridges. For example, the rotor may comprise a spindle module at the level of each deck of a multi-deck housing, each spindle module carrying a rotary contact bridge.

The disclosure also pertains to a rotary switch comprising a housing, a plurality of stationary contacts accommodated in the housing with a plurality of sides extending between a top side and a bottom side, at least one of the sides of the housing comprising access openings, each access opening providing access to an associated stationary contact at one of the sides of the housing in an access direction substantially parallel to an outer surface of said side. The access opening may for example be provided in a recess extending between the top side and the bottom side at a corner edge between two adjacent sides.

The disclosure also pertains to a rotary switch comprising a polygonal, e.g., rectangular, multi-deck housing wherein at least one of the decks accommodates at least six, e.g., at least eight stationary contacts. The stationary contacts may for example be accessible from a single side or from at least two, e.g., at least three sides or from all sides of the polygonal housing. The stationary contacts can for example be sunk within associated access openings.

The disclosed switch is particularly useful as a control switch, e.g., a low voltage control switch, e.g., as an AC or DC switch for voltages below 120 V.

The invention will be further explained with reference to the accompanying drawings showing exemplary embodiments of a rotary switch.

DETAILED DESCRIPTION

Figure 1:
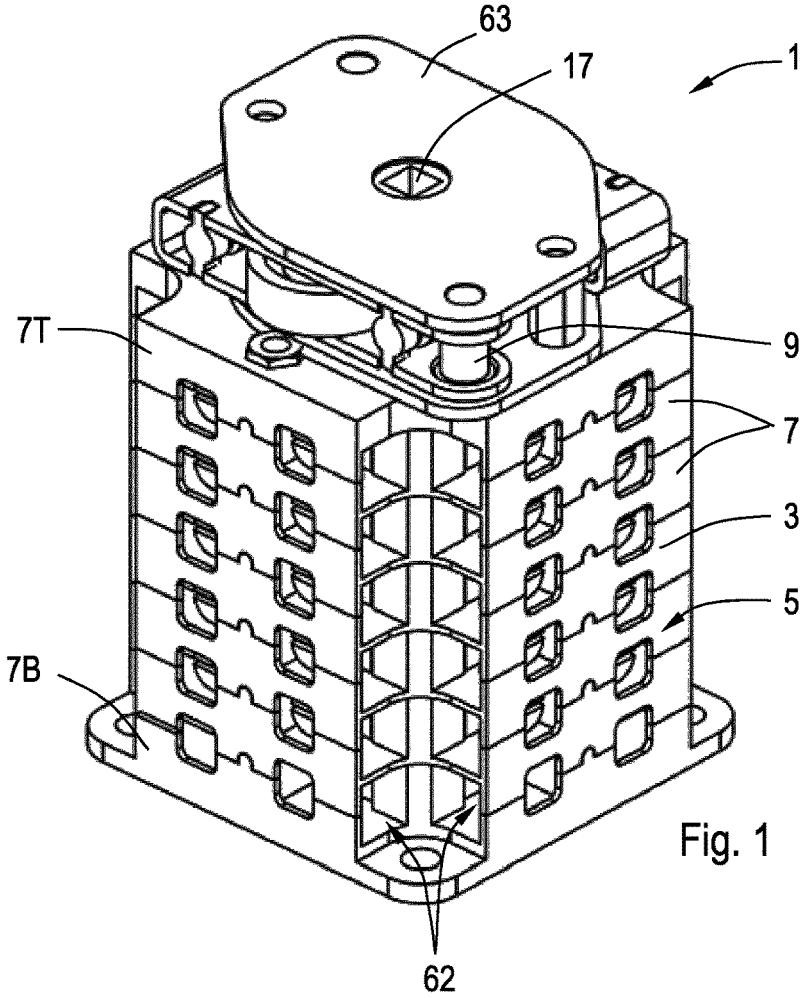
FIG. 1: shows an exemplary embodiment of a rotary switch.
Figure 2:
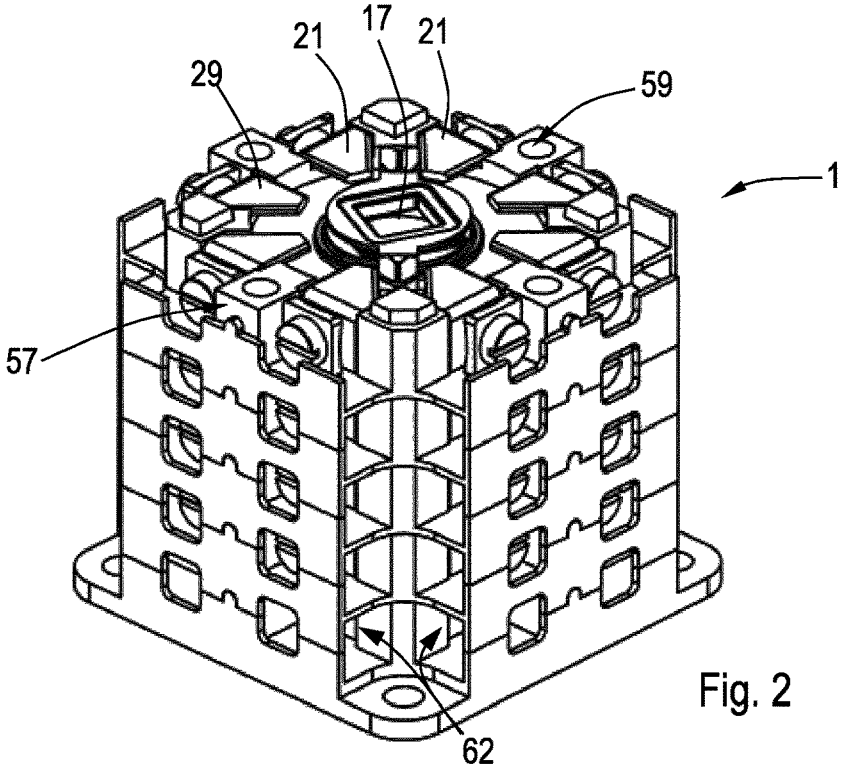
FIG. 2: shows the switch of FIG. 1 without its upper section.

FIG. 1 shows an electrical rotary switch 1 comprising a rectangular housing 3 with four substantially identical flat side faces 5. Adjacent side faces 5 are arranged under right angles with each other, resulting in a square outline of the housing 3 in top view (see FIG. 5).

The rotary switch 1 is a multi-deck switch, with the housing 3 being formed by a stack of decks 7 held together by bolts 9 (see in particular FIG. 3) extending between the top and bottom decks (7T, 7B) and nut locks (not shown) screwed onto the terminal ends of the bolts 9 projecting from the upper and lower decks 7T, 7B.

Figure 3:
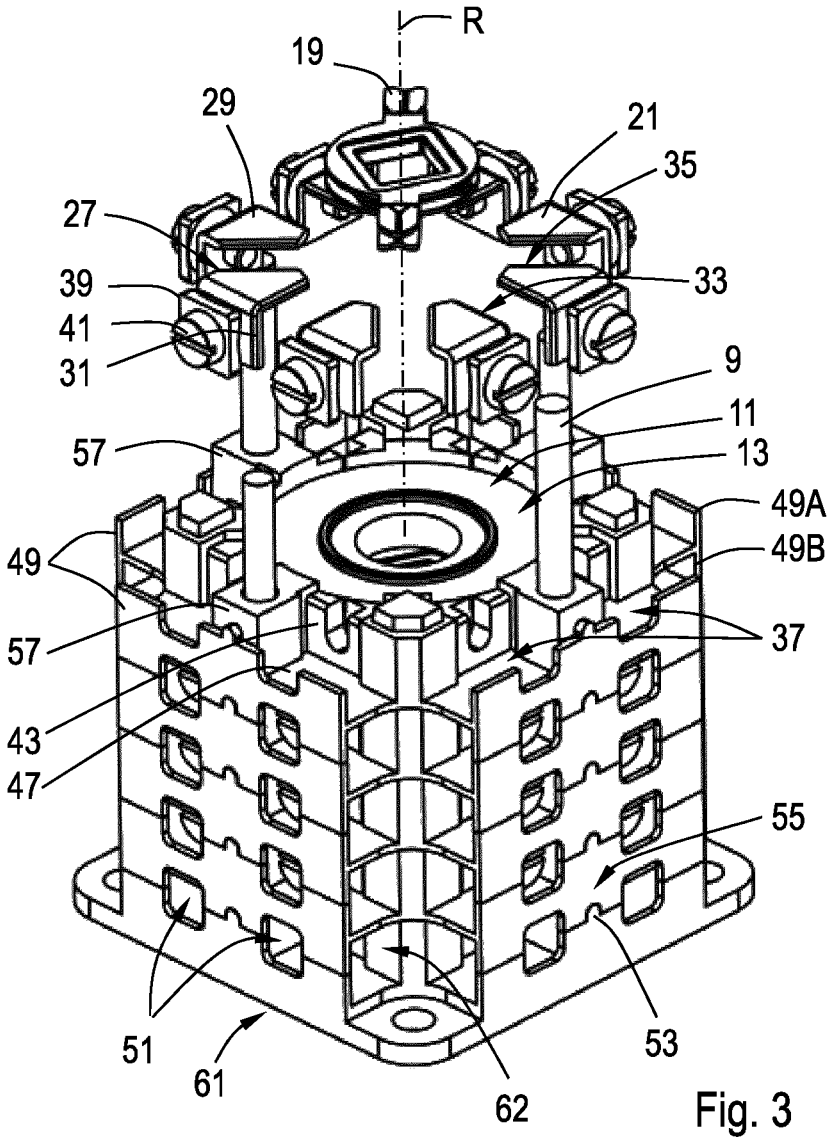
FIG. 3: shows the switch of FIG. 1 partly in exploded view.
Figure 4:
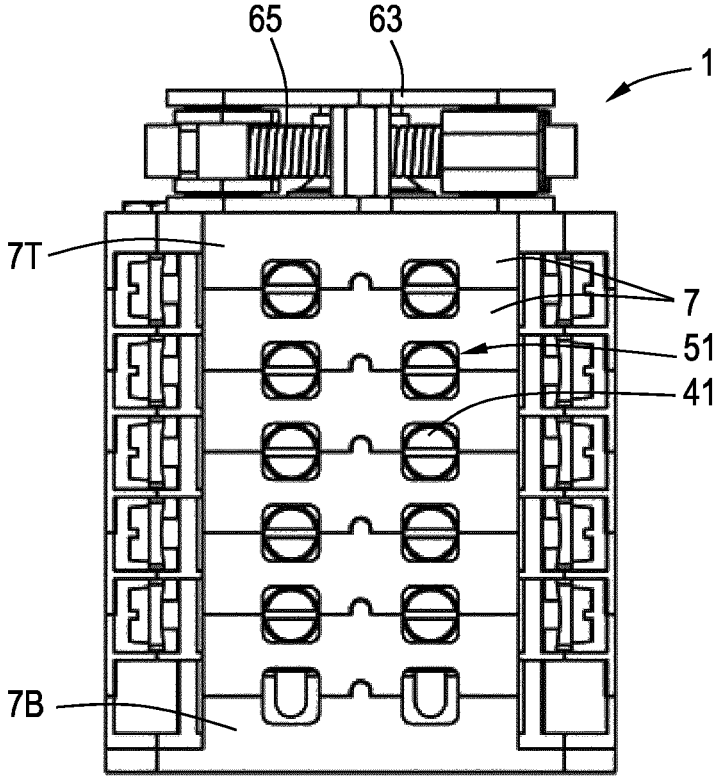
FIG. 4: shows the switch of FIG. 1 in side view.

Each deck 7 comprises a top surface 11 with a central circular recess 13 (see FIG. 3). The rotary switch 1 comprises a rotor 15 having a shaft 17 carrying a range contact bridges 19 (see FIG. 5) at the level of each of the decks 7. The shaft 17 is rotatable about a central rotational axis R, which forms a central axis of the rotary switch 1. All the flat side faces of the switch 1 are parallel to the rotary axis R.

The contact bridges 19 are accommodated in the associated circular recess 13 and have a length corresponding to the diameter of the recess 13, so the contact bridges 19 can be rotated over the full area of the circular recess 13. The contact bridges 19 may for example form a straight bridge contacting two diagonally opposite stationary contacts 21, or they may be shaped to contact a stationary contact 21 to a non-opposite stationary contact 21. The contact bridges 19 of the various decks 7 may be parallel, or they may make an angle with one another when viewed in top view.

Figure 5:
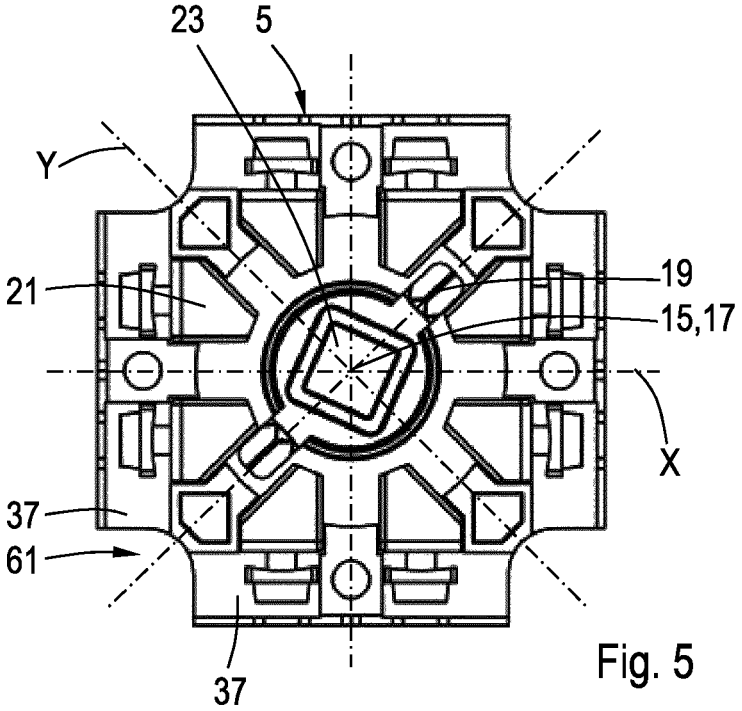
FIG. 5: shows the switch of FIG. 1 in top view with attached cables.
Figure 19:
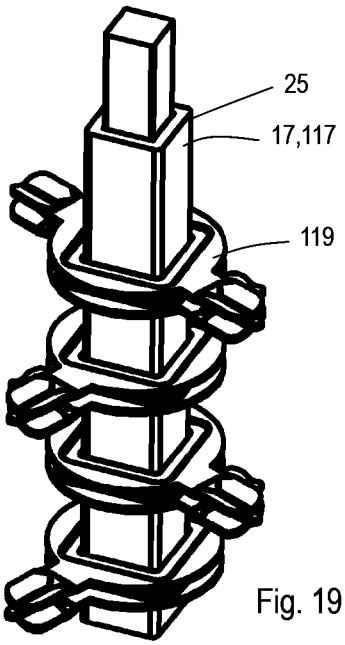
FIG. 19: shows an exemplary embodiment of a rotor shaft for the switch of FIG. 1 or the switch of FIG. 6.

The shaft 17 has a square cross section, e.g., a square steel rod 23 with an isolating square sheath 25. The square shaft 17 fits into a square central opening of the respective contact bridges 19 as shown in FIG. 5. FIG. 19 shows the shaft 17 of the rotor as a separate part. Other non-circular cross sections can also be used.

In the shown embodiment each deck 7 is provided with eight stationary contacts 21: two at each side face 5. In other embodiments, any other suitable number of stationary contacts can be used. The stationary contacts 21 are symmetrically arranged relative to the horizontal diagonals Y and center lines X (FIG. 5) and relative to the rotational axis R of the rotor 15 (FIG. 3).

Each stationary contact 21 comprises an angled piece of sheet metal which is bent along a folding line 27 to form a contact portion 29 for contacting the respective contact bridge 19, and a connection portion 31 to be connected to a conductor, e.g., a cable (not shown). The contact portion 29 and connection portion 31 of the angled piece are substantially under right angles with each other.

The contact portions 29 project into the circular recess 13 in the respective deck 7, in such manner that the contact portions 29 can be contacted by the contact bridge 19 of the rotor 15, when the rotor 15 is turned into a specific rotary position.

In the shown exemplary embodiment, the contact portions 29 are triangular with a short side 33 substantially perpendicular to the folding line 27 and a beveled side 35 linking the outer end of the folding line 27 and the outer end of the short side 33.

Each deck 7 comprises eight cavities 37 for accommodating a stationary contact 21: two cavities 37 at each side face. The stationary contacts 21 are placed in the respective cavities 37 in such way that they mirror both neighboring stationary contacts 21: At each side face 5 the two stationary contacts 21 of a deck are positioned with their short sides 33 facing each other, while the two stationary contacts 21 at each corner of the deck 7 are placed with their beveled sides 35 facing each other. All beveled side 35 are substantially parallel to a diagonal Y of the housing 3 in top view, while all short sides 33 are substantially parallel to a center line X perpendicular to the respective side face 5 in top view.

The contact portions 29 extend in a substantially horizontal plane, i.e., a plane substantially perpendicular to the axis of rotation R of the rotor 15 and point towards an opposite stationary contact 21. The connection portions 31 of the stationary contacts 21 extend substantially vertically pointing downwards.

The connection portions 31 comprise the downwardly extending part of the angled piece, a square washer 39 and a screw 41 for clamping the two together, in particular to clamp a terminal end of a cable conductor (not shown).

The cavities 37 in the decks 7 for accommodating the stationary contacts 21 have an inner wall 43 with a top surface supporting the contact portion 29 of the respective stationary contact 21 and an opening 45 for passage of the screw 41. The distance between the top surface of the wall 43 and a bottom 47 of the cavity 37 is slightly larger than the length of connection portion 31 of a stationary contact 21. At their top ends the cavities 37 are bordered by the bottom wall 47 of a corresponding cavity 37 in a next higher deck 7.

The bottom walls 47 of the respective cavities 37 connect to vertical partitions 49 jointly forming the outer wall of the housing 3. The partitions 49 comprise a section 49A extending upwards from the bottom wall 47 and a section 49B extending downwards from the bottom wall 47. The downwardly extending section 49B of one deck 7 meets the upwardly extending section 49A of a next lower deck 7 to form a substantially closed outer wall of the housing 3, except for two square openings 51 per deck 7 allowing access to the screws 41 of the stationary contacts 21. To align the various decks 7 the upwardly extending sections 49A comprise a centering lip 53 fitting into a matching centering recess 55 in the adjacent downwardly extending section 49B.

At each side of each deck 7 a block 57 between the two screws 41 separates the two cavities 37. These blocks 57 are provided with vertically extending passages 59 for passage of a bolt 9.

At the vertical corner edges the housing 3 is interrupted by vertically extending recesses 61 revealing sideward access openings 62 to the two adjacent cavities 37 and the respective stationary contacts 21 (FIG. 5). Terminal ends, e.g., of cable conductors can be inserted into the cavities 37 in a direction parallel to the respective side face 5 of the housing 3, instead of perpendicular to that side face, as is the case with prior art switches. The terminal ends can be placed between the washer 39 and the connection portion 31 of the angled piece. Subsequently the screw 41 can be tightened by a screw driver through the corresponding square opening 51. In this configuration the stationary contacts 21 are fully sunk within the housing and the fingers of a user are effectively protected.

The top end of the shaft 17 of the rotor 15 is connected to a rotary knob (not shown). The rotary knob is positioned on a cover plate 63. A spring mechanism 65 is sandwiched between the cover plate 63 and the top deck 7T of the housing 3 and biases the rotor 15 into specific positions. The spring mechanism 65 may for example be carried out as the mechanism disclosed in, e.g., GB 1,159,729 or WO 2013/079091.

FIGS. 6 to 10 show an alternative embodiment of a rotary multi-deck switch 101. The switch 101 comprises a rectangular housing 103 with four substantially identical flat side faces 105 extending between a bottom side and a top side. Adjacent side faces 105 are arranged under right angles with each other, resulting in a square outline of the housing 103 in top view (see FIG. 10). In alternative embodiments the outline may for example be rectangular or polygonal.

The housing 103 is composed of a stack of decks 107 held together by bolts 109 (see in particular FIG. 8) extending between the top and bottom decks 107T, 107B and nut locks (not shown) screwed onto the terminal ends of the bolts 109 projecting from the upper and lower decks 107T, 107B.

The switch 101 comprises a rotor 115 with a shaft 117, shown in FIG. 19 (not shown) extending centrally through central passages 112 in the decks 107 (see FIG. 18) and supporting electro-conductive rotary contact bridges 119. The rotor 115 is similar to the rotor 15 of the embodiment of FIGS. 1 to 6, as described above. Each deck 107 has a top face with a circular recess 113, the rotor passage openings 112 being coaxial with the circular recesses 113. Each one of the contact bridges 119 of the rotor 115 is accommodated in an associated circular recess 113 of a respective deck 107 and has a length corresponding to the diameter of the recess 113, so the contact bridges 119 can be rotated over the full area of the circular recess 113.

Figure 8:
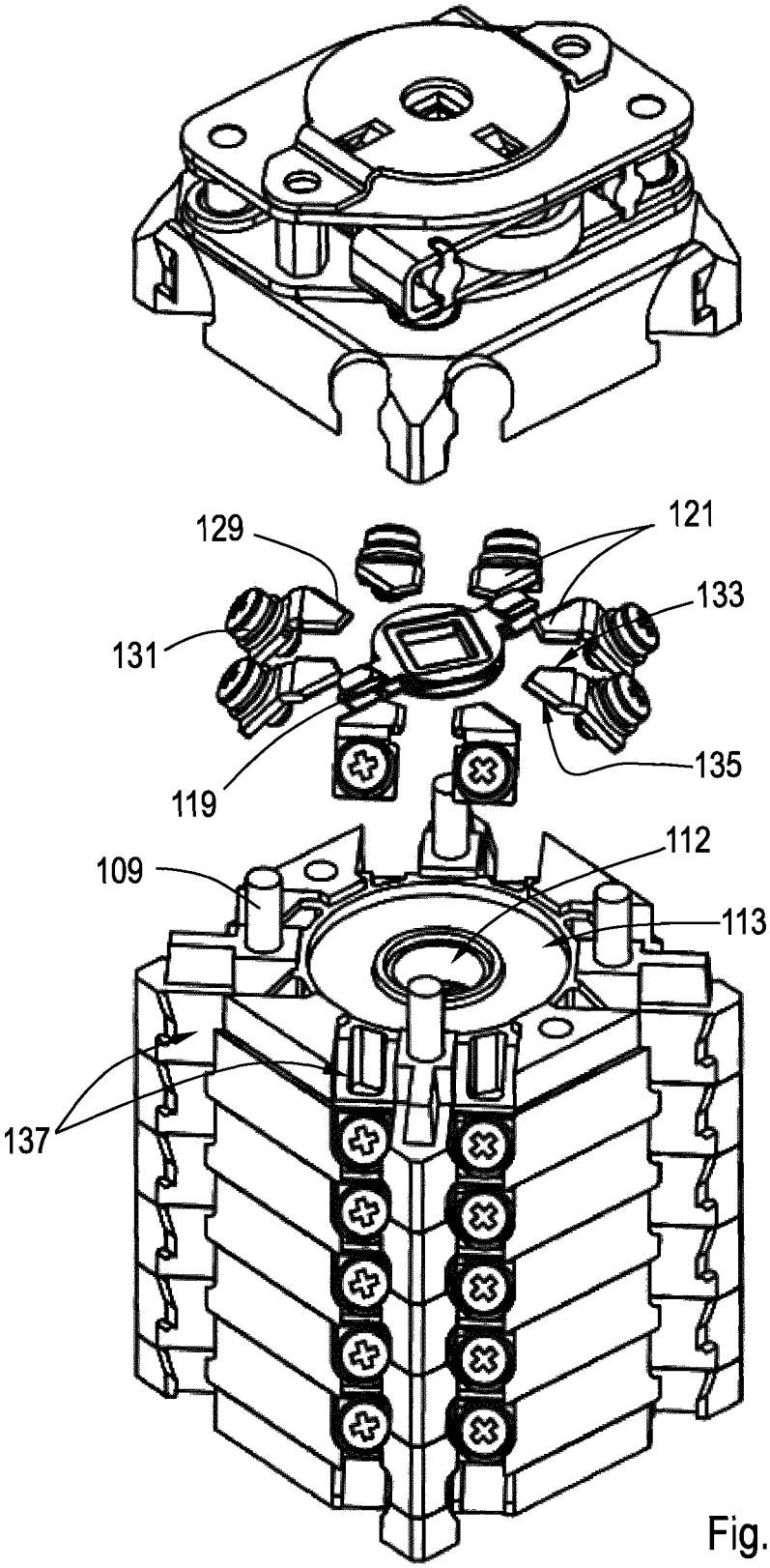
FIG. 8: shows the switch of FIG. 6 partly in exploded view.
Figure 9:
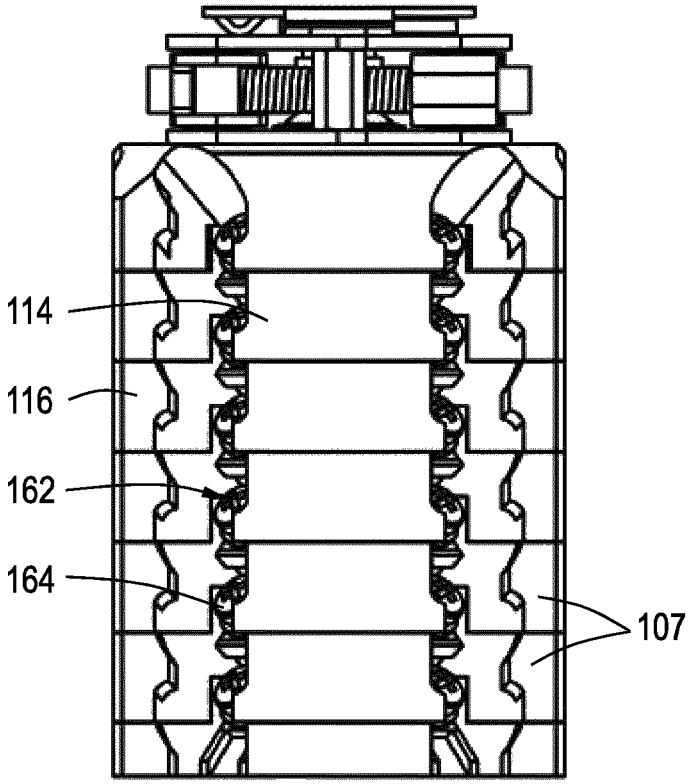
FIG. 9: shows the switch of FIG. 6 in side view.
Figure 16:
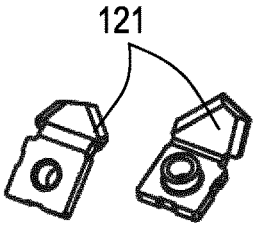
FIGS. 15-17: show exemplary embodiments of stationary contacts.

Each deck 107 is provided with eight stationary contacts 121: two at each side face 105. The stationary contacts 121 are symmetrically arranged relative to the horizontal diagonals Y and center lines X (FIG. 10) and relative to the rotational axis R of the rotor 115 (FIG. 8). FIG. 16 shows the stationary contacts as 121 separate parts.

Each stationary contact 121 comprises a contact portion 129 for contacting the respective contact bridge 119, and a connection portion 131 to be connected to a conductor, e.g., a cable (not shown). The stationary contacts 121 are similar to the stationary contacts 21 of the embodiment shown in FIGS. 1 to 5, except in that the angle between the contact portion 129 and the connection portion is larger (for instance between about 110 and about 130 degrees).

Figure 6:
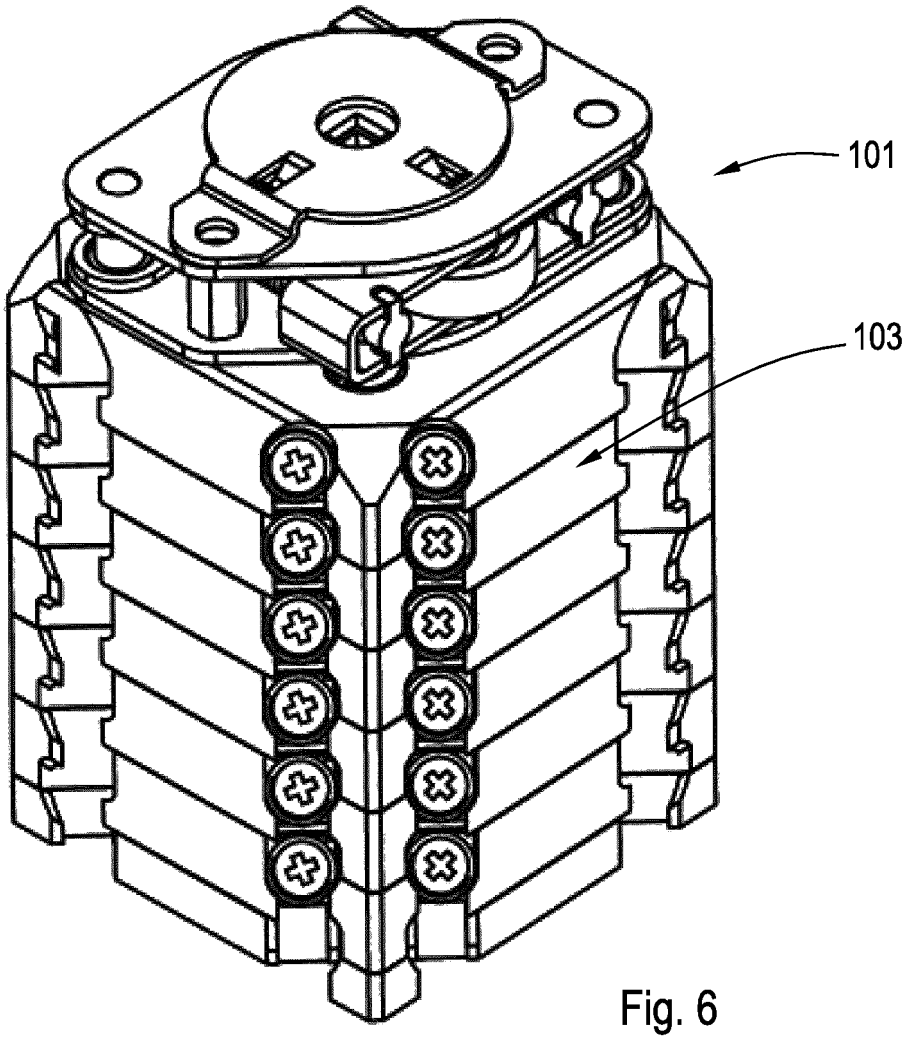
FIG. 6: shows an alternative embodiment of a rotary switch.
Figure 7:
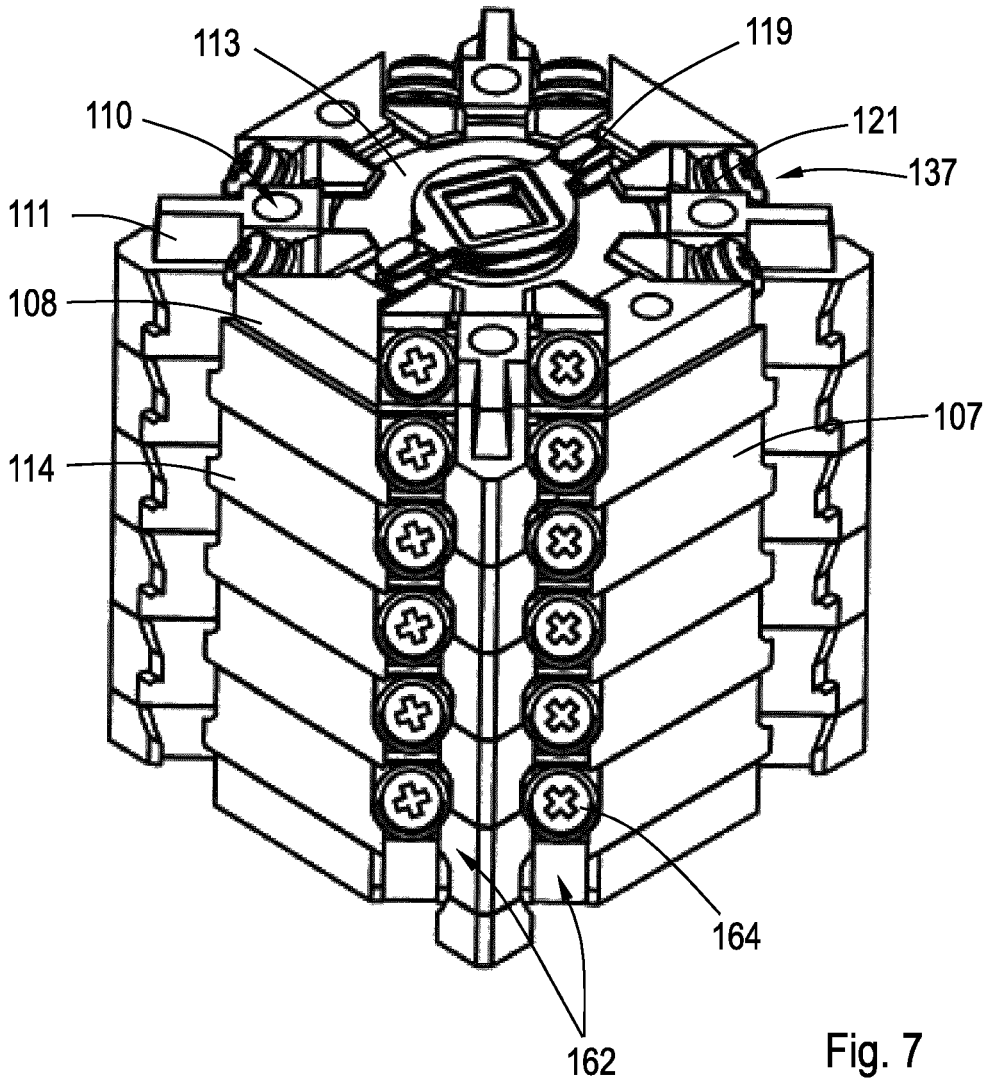
FIG. 7: shows the switch of FIG. 6 without its upper section.

Also the arrangement of the stationary contacts 121 is different compared to the arrangement of the stationary contacts 21 in the embodiment of FIG. 1: while the stationary contacts 21 in FIG. 1 (viewed in top view) extend in a direction substantially perpendicular to the respective side face 5, the stationary contacts 121 of the FIG. 6 embodiment extend in directions parallel to the nearest diagonal of the rectangular outline.

Figure 24:
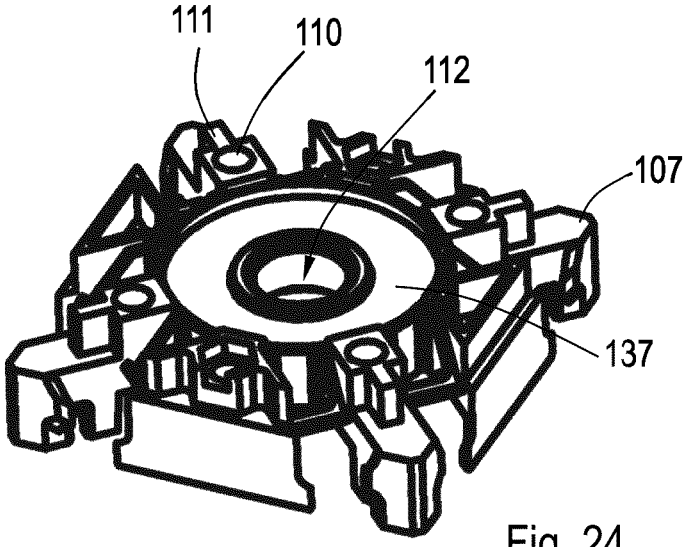
FIG. 24: shows a single deck of a switch of FIG. 6 in perspective top view.
Figure 25:
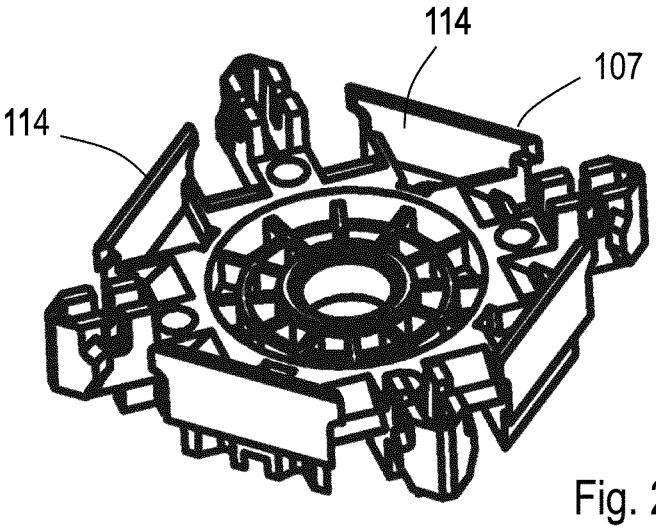
FIG. 25: shows the deck of FIG. 24 in perspective bottom view.

Separate decks 107 are shown in FIGS. 24 and 25. Each deck 107 comprises a base 108 with a top face exposing the central circular recess 113 and the central passage 112 for the rotor 115. Near each corner, the base 108 is provided with vertical holes 110 for the connection bolts. A partition 111 extends diagonally from each hole 110 towards the nearest corner edge. At either sides of each hole 110 the base 108 is provided with downwardly inclined recesses 137 shaped to receive the connection portion of a stationary contact such that its contact portion extends horizontally into the space of the circular recess to allow it to be contacted by a contact bridge of the rotor 115.

Figure 10:
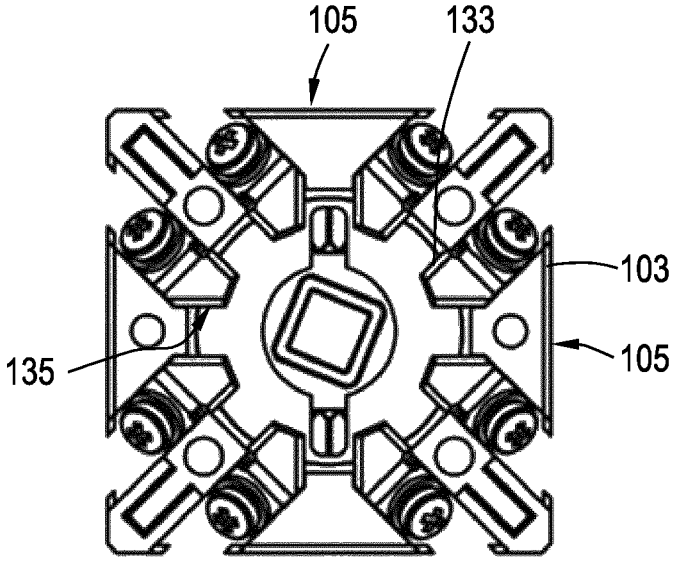
FIG. 10: shows the switch of FIG. 6 in top view.

Each deck 107 comprises eight recesses 137, each recess 137 accommodating a stationary contact 121: two recesses 137 at each corner edge. The stationary contacts 121 are placed in the respective recesses 137 in such way that they mirror both neighboring stationary contacts 121 (see, e.g., FIG. 10): At each side face 105 the two stationary contacts 121 of a deck 107 are positioned with their beveled sides 135 facing each other, while the two stationary contacts 121 at each corner of the deck 107 are placed with their short sides 133 facing each other. All short sides 133 are substantially parallel to a diagonal Y of the housing 103 in top view, while all beveled sides 135 are substantially parallel to a center line X perpendicular to the respective side face 105 in top view (FIG. 10).

The contact portions 129 of the stationary contacts 121 extend in a substantially horizontal plane, i.e., a plane substantially perpendicular to the axis of rotation R of the rotor 115 and point towards an opposite stationary contact 121. The connection portions 131 of the stationary contacts 121 extend downwardly making an angle, e.g., of about 20-40 degrees with the vertical to optimize accessibility.

The base 108 of each deck 107 has four side faces provided with a skirt 114 covering a lower part of the side face of the base 108 and projecting downwardly from a bottom face of the deck 107. The length of the skirt 114 corresponds to the thickness of the base 108, such that the skirts 114 of the stacked decks 107 of the switch 101 from a closed wall, only interrupted by the recesses 137 for the stationary contacts 121 and optionally further functional openings, such as an optional exhaust channel (not present in the shown embodiment). Also the corner edges are provided with such a skirt sections 116. Near the recesses 137 the skirt sections 114, 116 have side edges shaped to form circular access openings 162 for fastening or loosening screws 164 holding the stationary contacts 121 (see FIG. 7).

Cables or similar conductors (not shown) can be linked to the connection portions 131 in diagonal direction relative to the rotary switch 101.

The top side of the switch 101 is provided with the same provisions for a rotary knob as the embodiment of FIGS. 1 to 5.

Figure 11:
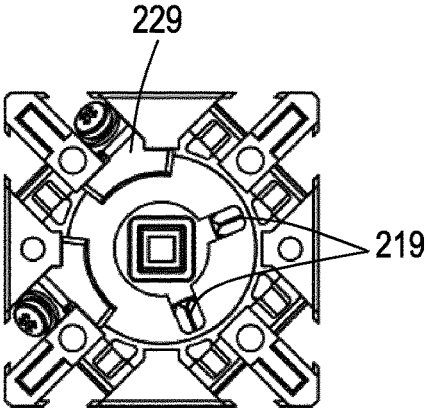
FIGS. 11-14: show the view of FIG. 10 with alternative stationary contacts
Figure 17:
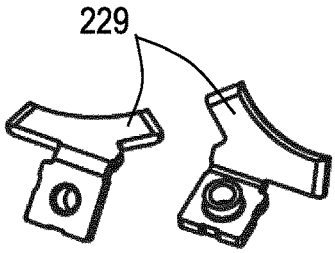

FIGS. 11 to 14 show alternative arrangements of the stationary contacts and the contact bridges. In FIG. 11 the two stationary contacts have extended asymmetrical contact portions 229. Also the contact bridge is asymmetrical, with the rotary contacts 219 not being aligned but making an angle with each other. FIG. 17 shows the same stationary contacts separately.

Figure 12:
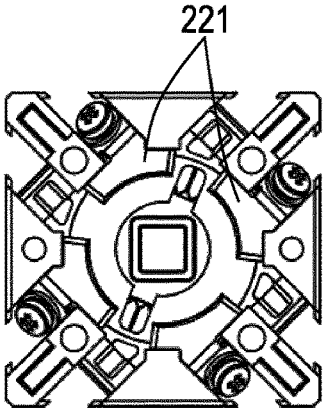

FIG. 12 corresponds to FIG. 11 but has four stationary contacts 221 instead of two.

Figure 13:
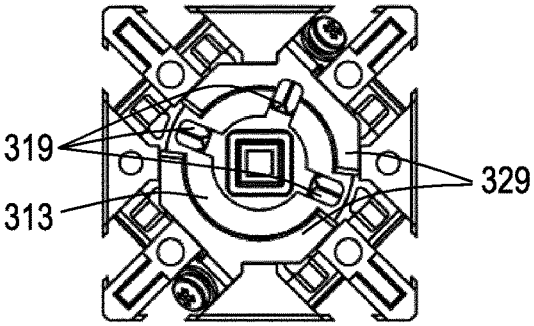
Figure 14:
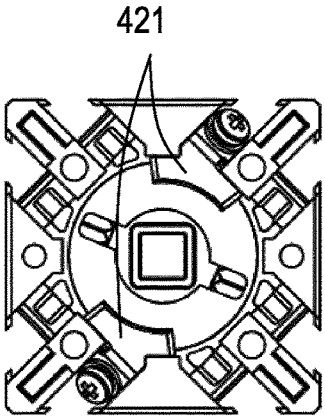
Figure 15:
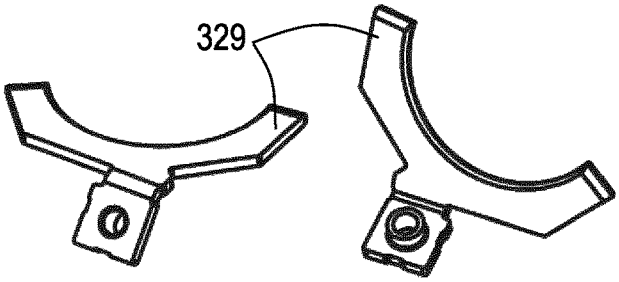

In FIG. 13 the two stationary contacts have extended contact portions 329 extending along about the half of the outline of the circular recess 313. The stationary contacts are shown as separate parts in FIG. 15. The contact bridge has three rotary contacts 319. FIG. 14 corresponds to FIG. 12 but with only two stationary contacts 421 which are oppositely arranged.

Figure 18:
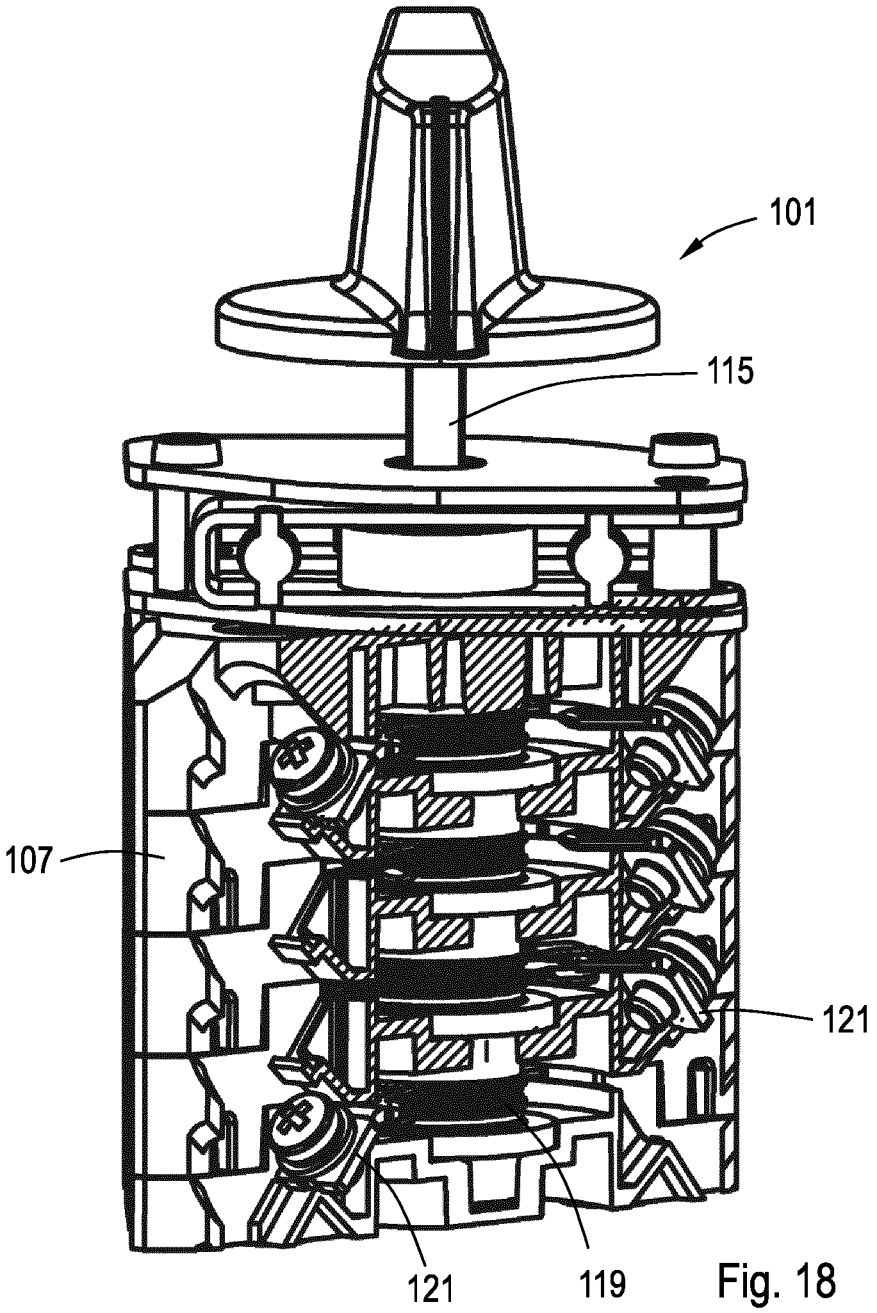
FIG. 18: shows the switch of FIG. 6 in perspective cross section.

FIG. 18 shows the rotary switch cut in two along a vertical central plane to show the position and build-up of the rotor, shown separately in FIG. 19.

Figure 20:
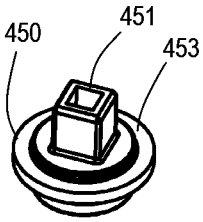
FIGS. 20-21: show an exemplary spindle module.
Figure 21:
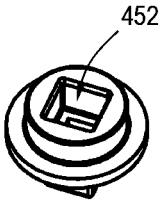
Figure 22:
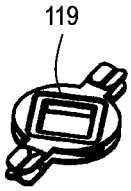
FIG. 22: shows and exemplary embodiment of a rotary contact bridge.
Figure 23:
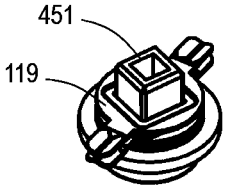
FIG. 23: shows an assembly of a spindle module with a rotary contact bridge

In an alternative embodiment, the rotor may comprise a modular spindle comprising spindle modules which are mechanically connected to form a shaft carrying the rotary contact bridges. For example, each deck encases a spindle module and a rotary contact bridge. FIGS. 20 and 21 show an exemplary embodiment of such a spindle module 450, having a square top end 451 (FIG. 20) and a bottom end with a square opening 425 for receiving a square top end 451 of a similar spindle module. Between the top and bottom ends the module has a circular collar 453. A rotary contact bridge (FIG. 22) can be fit over a square top end 451 of the spindle module 450 in order to be locked between two stacked spindle modules 450 (FIG. 23).

Elements and aspects discussed for or in relation with a particular embodiment may be suitably combined with elements and aspects of other embodiments, unless explicitly stated otherwise.

It is noted that the drawings are schematic, not necessarily to scale and that details that are not required for understanding the present invention may have been omitted. The terms "top", "bottom", "upwards", "downwards", "below", "above", "vertical" and "horizontal" and the like relate to the embodiment as oriented in the drawings.

The invention claimed is:

1. A rotary switch comprising:

a rotor supporting at least one electro-conductive rotary contact bridge;

a plurality of stationary contacts;

a polygonal housing as viewed in a top view, accommodating the stationary contacts and the rotor, the rotor being rotatable within the housing between a plurality of positions, in which the rotary contact bridge contacts different combinations of stationary contacts;

wherein the rotary switch is a multideck switch, and the housing comprises;

a plurality of sides extending between a top side and a bottom side, each side of the plurality of sides being provided with access openings, each access opening providing access to an associated stationary contact, and each of said sides of the plurality of sides making an angle with each other; and a stack of decks, at least one of the decks accommodating two stationary contacts at each side of the at least one of the decks.

2. The rotary switch according to claim 1, comprising a rectangular housing, each deck accommodating an array of eight access openings.

3. The rotary switch according to claim 2, the rotor comprising two contacts per deck at opposite sides of the rotor relative to a rotational axis of the rotor.

4. The rotary switch according to claim 3, wherein an access opening for a given stationary contact at a given housing side is provided in a wall of each said recess substantially perpendicular to a side face of the given housing side.

5. The rotary switch according to claim 2, wherein the access openings provide access in a direction substantially parallel to a respective side face.

6. The rotary switch according to claim 1, wherein an access opening for a given stationary contact at a given housing side is provided in a wall of each said recess substantially perpendicular to a side face of the given housing side.

7. The rotary switch according to claim 1, wherein the access openings provide access in a direction substantially parallel to a respective side face.

8. The rotary switch according to claim 7, wherein the stationary contacts comprise a connection portion for connecting to a terminal end of a conductor, the connection portion being substantially parallel to the respective side face.

9. The rotary switch according to claim 8, wherein the connection portion of the stationary contact comprises a washer and a screw for fastening the washer, and the respective side face being provided with an opening providing access to the screw.

10. The rotary switch according to claim 1, wherein the stationary contacts have a longitudinal axis extending parallel to a diagonal of the housing, as viewed in a top view.

11. The rotary switch according to claim 1, wherein the stationary contacts are sunk within respective access openings.

12. The rotary switch according to claim 1, comprising a stack of decks held together by bolts crossing the stack of decks.

13. The rotary switch according to claim 1, the rotor comprising a shaft with a substantially square cross section.

14. The rotary switch according to claim 13, wherein the shaft comprises a steel core encased in a square isolative sheath.

15. The rotary switch according to claim 1, wherein the rotor comprises spindle modules which are mechanically connected or connectable to form a shaft carrying the at least one rotary contact bridge.

16. The rotary switch according to claim 1, wherein the housing is square or rectangular.

17. A rotary switch comprising:

a rotor supporting at least one electro-conductive rotary contact bridge;

a plurality of stationary contacts;

a housing accommodating the stationary contacts and the rotor, the rotor being rotatable within the housing between a plurality of positions, in which the rotary contact bridge contacts different combinations of stationary contacts;

wherein the housing comprises a plurality of sides extending between a top side and a bottom side, at least two of the plurality of sides being provided with access openings, each access opening providing access to an associated stationary contact, each of said two sides of the plurality of sides making an angle with each other, and at least one recess along at least on of said corner edges, the access openings providing access to the stationary contacts provided in the at least one recess.

* * * * *